US009056693B2

(12) United States Patent
Lattanzi et al.

(10) Patent No.: US 9,056,693 B2
(45) Date of Patent: Jun. 16, 2015

(54) MACHINE FOR PLACING PROTECTIVE DIVIDERS OF BOTTLES CONTAINED IN PACKAGING BOXES

(76) Inventors: Marisa Rosana Lattanzi, Pcia. de Santa Fe (AR); Laura Isabel Lattanzi, Pcia. de Santa Fe (AR); Fernando Adrián Lattanzi, Pcia. de Santa fe (AR); Carina Adriana Lattanzi, Pcia. de Santa Fe (AR)

( * ) Notice: Subject to any disclaimer, the term of this patent is extended or adjusted under 35 U.S.C. 154(b) by 1015 days.

(21) Appl. No.: 13/067,889

(22) Filed: Jul. 5, 2011

(65) Prior Publication Data

US 2012/0167524 A1 Jul. 5, 2012

(30) Foreign Application Priority Data

Jul. 29, 2010 (AR) ..... P100102742

(51) Int. Cl.
*B65B 61/20* (2006.01)
*B65B 21/02* (2006.01)
*B65B 21/04* (2006.01)

(52) U.S. Cl.
CPC ..... *B65B 61/207* (2013.01); *B65B 61/20* (2013.01); *B65B 21/02* (2013.01)

(58) Field of Classification Search
CPC ..... B65B 43/30; B65B 61/20; B65B 21/24; B65D 5/48
USPC ..... 53/157, 250, 263, 445, 448, 48.8, 398
See application file for complete search history.

(56) References Cited

U.S. PATENT DOCUMENTS 3,473,295 A * 10/1969 Nigrelli et al. ..... 53/393
3,803,993 A * 4/1974 Graham ..... 493/90
5,600,936 A * 2/1997 Moncrief et al. ..... 53/263
5,833,046 A * 11/1998 Smith et al. ..... 198/458
7,302,785 B2 * 12/2007 Heuvel et al. ..... 53/445
2004/0068961 A1 * 4/2004 Chalendar et al. ..... 53/398
2008/0223002 A1 * 9/2008 Lanfranchi ..... 53/250

FOREIGN PATENT DOCUMENTS

EP 1736413 A1 * 12/2006 ..... B65D 5/48

* cited by examiner

*Primary Examiner* — Thanh Truong
*Assistant Examiner* — Justin Citrin
(74) *Attorney, Agent, or Firm* — Merek, Blackmon & Voorhees, LLC

(57) ABSTRACT

A machine to be incorporated in a packaging line for beverage packages such as wines and sparkling wines, in a stage after the entering of bottles into a box, and before the closing of same. The machine is formed into a fixed frame (B) interposed in the packaging line, the fixed frame defining a lower sector where the boxes carrying the bottles pass, and a higher sector having a carrier horizontal frame for at least one placing head (C). The dividers (S) each comprise at least a pair of flexible laminar plates with square format joined to each other through a central and vertical adhesive line disposed between their opposite faces. Each placing head (C) has a feeding lane of folded dividers (S) that faces a sliding pneumatic extractor, a carrier of suction pads (17) and (18), which suction and hold the dividers in a unitary form, to dispose them in vertical alignment with a forming set, pneumatic and vertically displaceable pneumatic acting set, formed by folding guides (9) and (9'), which acts in combination with a vertical pushing arrangement operated by a pneumatic cylinder (31), by which the formed divider (S) is placed between the bottles in the packaging box, disposed one after the other, inside the same frame, having any of which its own divider feeding lane.

5 Claims, 9 Drawing Sheets

MACHINE FOR PLACING PROTECTIVE DIVIDERS OF BOTTLES CONTAINED IN PACKAGING BOXES

CROSS-REFERENCE TO RELATED APPLICATION

The present application claims the priority under 35 U.S.C. 119 of Argentine Patent Application No. AR P 2010 0102742 filed on Jul. 29, 2010, which is hereby incorporated herein by reference in its entirety.

FIELD OF THE INVENTION

The present invention is directed mainly to a machine for placing protective dividers of bottles contained in packaging boxes, which is capable to act in a manual, semi-automatic and totally automatic way, entering and placing dividers in the inner part of the packaging box, when bottles are placed inside.

More specifically, the present invention refers to a fitting machine, specially designed to act on a specific model of protective divider for bottles, thus combining different acting resources through which each folded divider is taken individually, it is given its definitive format, but unfolding it, and is transferred until it is appropriately placed between the bottles contained in the packaging box.

It refers to a fitting machine which may be incorporated in the packaging line of beverage packages such as wines and sparkling wines, after the entering of bottles in the box, and before the closing of same.

The invented machine comprises resources suitable to act in bottle dividers made of at least a pair of flexible laminar plates with square format which are joined to each other through a central and vertical adhesive line disposed between their opposite faces.

It is also contemplated that the divider is made of three square plates, one central and two lateral ones, which are bonded to the first, through their planar opposite main faces, by respective central and vertical adhesion lines.

In preferred embodiments, these dividers are made of solid fiber plates which are distinguished because, and at the same time they show a good capacity of resistance and absorption to specific knocks, they keep certain flexible condition in order to adopt the required format to form the divider constituted in each case.

Specifically, it refers to bottle dividers described and illustrated in Argentinean Patent of Invention with Application Number P 05 010 2625.

In order to put the above purpose into practice, the placing machine of the present invention, comprises un a feeding line of folded dividers, associated to an individual collecting pneumatic resource of each divider, which transfers it to face it to a corresponding pushing means which function is to displace it vertically from top to bottom so that, in a first stage, they go through a corresponding forming set which comprises a displaceable forming mechanic resource and then, once formed, continue to advance till they are duly positioned between the bottles contained in the packaging box.

The invented machine is controlled by means of a specific program commanded by a "PLC", and includes a command panel where all the operations usually required in this kind of processes are foreseen, either tuning, alarm resources and stoppage due to inconveniences, with options to act in a manual, semi-automatic and totally automatic way.

It refers to an invention which defines a new combination of means thought to achieve a higher result, being it unpredictable and surprising also for a person skilled in the art. Consequently, besides of being new, its constructive and functional conception shows a clear inventive activity, such that, it gathers the conditions demanded by Law to be considered a patent of invention.

PRIOR ART

Until some years ago, the dividers for bottles were, almost all, made of corrugated carton and its placement into packaging boxes was performed in a manual way; the work of workers was required for them to individually spread, until they adopt their definitive format, and then they are placed between the bottles contained in each box.

This method is still in use, above all in small scale production, due to the elevated cost and the complexity showed by the integral automatic placement offered by the current machines.

It may be said that there are not actually automatic machines for placing corrugated carton dividers, since it is a very complicated material to be treated. Therefore, they are being replaced by the solid fiber carton which clearly are superior to the ones made of corrugated carton in that they are cleaner (do not leave burrs), take less space when they are stored folded and grouped in blocks, and also when they are spread out they are placed in the inner part of boxes, being its manipulation less complicated than with the automatic machines.

Therefore, there are in the market different models of solid fiber dividers applicable to sets of bottles contained in packaging boxes.

In many cases, these known dividers, have the respective machines specially created for placement in said packaging boxes.

Since most of known dividers are complex as regards format and constitution, the placing machines are also complex and, in general, extremely expensive not only for purchase, but also for maintenance.

It is also noted that each placing machine can only act on a single model of divider, for which it has been created, being it very complicated to adapt them to another different divider design.

DESCRIPTION OF THE INVENTION

Advantages

The placing machine referred to by the present patent of invention, has been specially designed to act in solid fiber dividers which basically form at least two plates of this material, with a square form, which are bonded together, by their opposite faces, by means of a vertical adhesive line.

With the folded divider, both plates are disposed with their opposite faces overlapped thus defining a minimum thickness.

With the unfolded divider, in use condition, both plates are linked in a zone where the above mentioned vertical adhesion line is formed, such that one of them projects their lateral stretches forward to form a pair of lateral partitions, while the other is still planar to give a conformation to a backup parameter.

They both define three adjacent open cavities, each one is intended to hold and enclose laterally a respective bottle with the object to receive and absorb the expected knocks by transversal movements which may be produced during transfers.

The machine of this invention is also suitable to place dividers of this kind created to be disposed among six equal bottles contained in a box, in which case, instead of two solid fiber plates they comprise three overlapped square plates, in this case placing two lateral plates, which are linked, respectively, to a central one by means of corresponding vertical adhesive lines.

In this case, the central plate acts as a backup parameter for both alignments of open holding cavities which form the above mentioned lateral plates duly unfolded.

The machine referred to by the present patent of invention is formed into a frame structured to be inserted in the packaging line, in the previous where the packaging box closure is executed which advances with the incorporated bottles.

The machine of this invention is disposed over the boxes with capability to act on one or more of them simultaneously, for which a placing head is used in which a forming set created to perform the definitive unfolding of each divider along with a positioning pushing resource in the packaging box works.

Each placing head is formed with a respective feeding line where the block of folded dividers advances, which are taken, one after the other, by means of a sliding suctioning pneumatic means, which positions them to be delivered to the referred forming set which acts in combination with the above mentioned pushing means.

A single machine may be designed to act with a plurality of placing heads, each one with its own divider feeding lane.

To proceed with the assembly of each divider in the forming set, a respective sliding suctioning pneumatic means is used, which is capable to activate a pair of suction pads which by means of a little vacuum generating suction, retain each divider to transfer it until it is aligned with the forming set acting in combination with a pushing means.

In fact, it may be said that in each placing head, a forming set constituted by folding guides capable of being vertically displaced act in a coordinated fashion, acted by a pneumatic cylinder, combined with a pushing means, which function is the displacement of the divider which is being unfolded and forming it until it is part of the box, suitably interposed, between the included bottles.

This embodiment is highlighted by the simple operation performed with the forming set, to transform each divider, which is provided in a folded way, and dispose it in an unfolded position, with its definitive form, duly aligned and positioned, in due condition to enter the box.

This forming set may act in a manual way such that a worker acts it as required, or also automatically, from a programmable electronic controller, with capability to unfold and deliver each divider, as the controller is ordered.

The machine of this invention, this way constituted, shows clear advantages as regards construction and functionality over the other currently known machines, first because it may be designed depending on the requirements shown in each case. It may be a small machine suitable for smaller scale productions, which occupies a smaller space in the packaging line, until an embodiment of several placing heads is configured, which is capable for big productions.

Due to its assembly and structure, it is also remarkable since it is simpler than the known ones; it is very fast for placing work, and very efficient, since it is proved that it shows a very low percentage of placing failures.

The above mentioned simplicity of assembly and structure provides the advantage of a clear reduction of purchase costs, as well as maintenance.

It is also noted the capability of rapidly adapting to different sizes and configuration of the dividers, as a function of design and size of the packaged bottles (red, Burgundy wines, champagne, etc.), for which only little modifications are performed in the opening set.

Inventive Activity

No currently known fitting divider machine proposes, and not even suggests the constructive solution which arises from the items mentioned in the above paragraphs, since it refers to a proposal which, besides of being novel, has a clear inventive activity.

BRIEF DESCRIPTION OF THE DRAWINGS

In order to achieve the above described advantages, to which users and those skilled in the art may add many others, and to facilitate the understanding of construction, constitution and functional characteristics of the invented machine, below there is an example of a preferred embodiment which is schematically described and without a specific scale in the enclosed figures, with the express comment that, as it is an example only, it should not be taken as limitation to the scope of protection of the present patent of invention, but it is simply explanatory and illustrative of the basic conception on which it is based.

It is noted that, in all figures, the same reference numbers and letters, correspond to the same or equivalent parts or elements constituting the set, in accordance with the example chosen for the present explanation of the invented machine.

DETAILED DESCRIPTION OF A PREFERRED EXAMPLE

Figure 1:
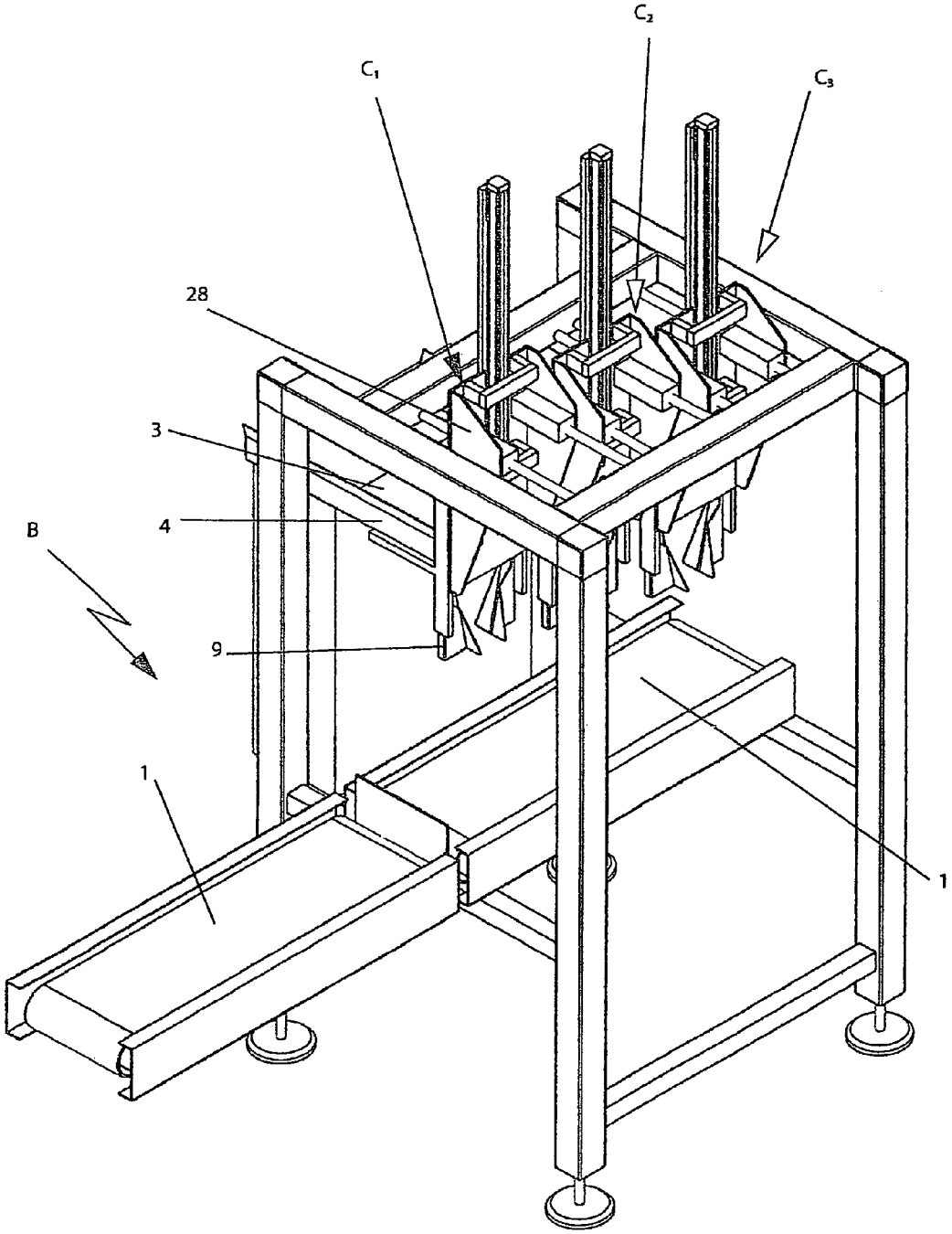
FIG. 1 is a schematic, perspective view that shows a fitting machine such as the one referred to in the present patent of invention, in a preferred embodiment which contemplates the use of three placing heads.

As it can be observed in FIG. 1, the divider placing machine referred to by the present patent of invention, is formed into a frame (B) suitable to be put between the packaging line which is set at the product packaging plant, such as wine and the like, which are packaged in bottles and then put in packaging boxes for transport and storage. This frame is emphasized because it defines a lower sector in which a conveying belt (1) is placed where boxes carrying bottle sets grouped in pre-established and duly ordered amounts of bottles advance (not shown).

Figure 8:
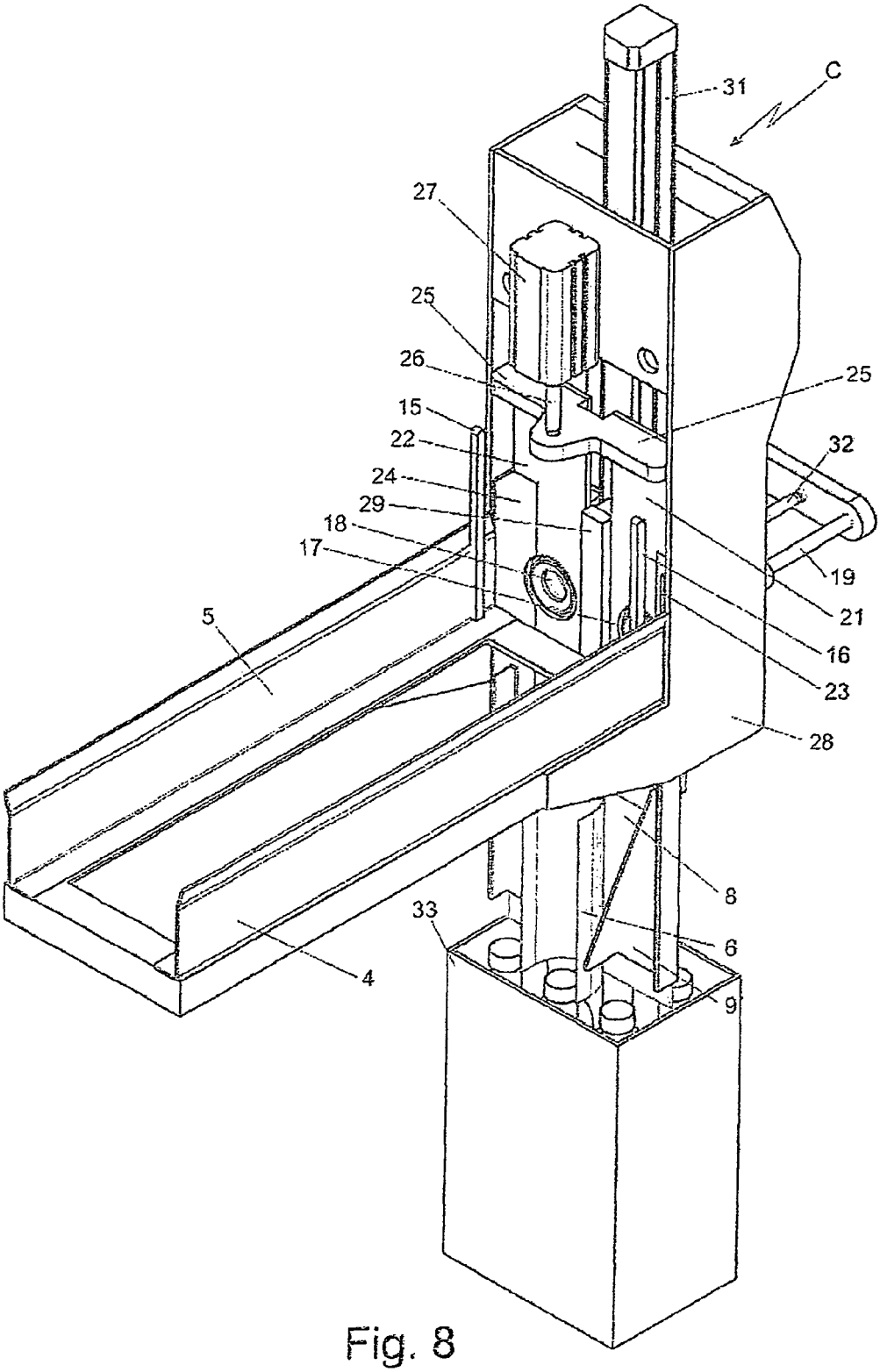
FIG. 8 is also a perspective view, similar to previous figures, which represents the same placing head, in this case showing the divider already formed advancing to the block of aligned bottles.
Figure 9:
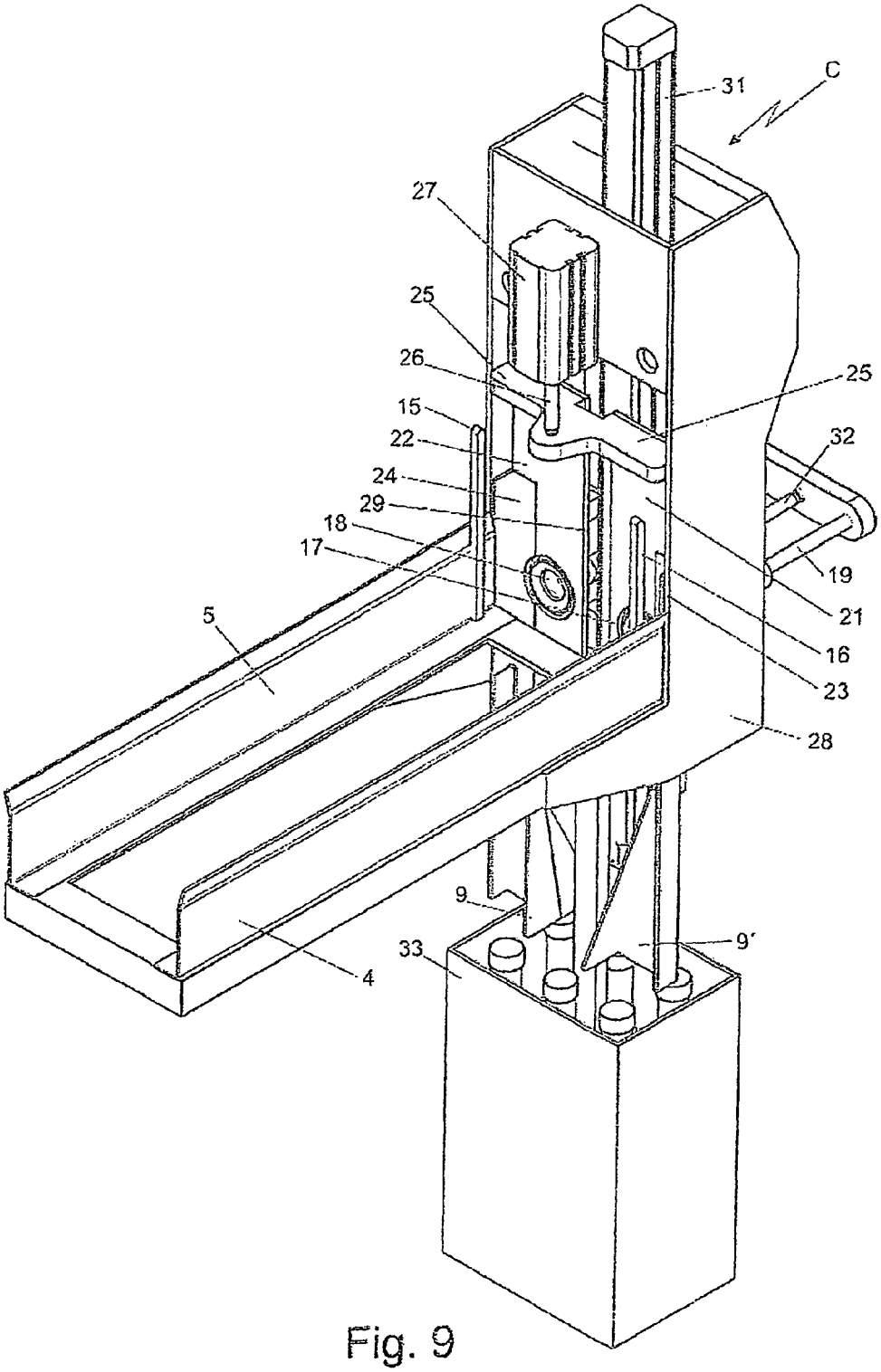
FIG. 9 is also a perspective view, similar to previous figures, which represents the same placing head, in this case showing the divider placed in the block of bottles.

As shown in FIGS. 8 and 9, this preferred example refers to boxes containing six bottles duly aligned in two rows of three bottles each.

Said conveying belt goes through the retractile top (2) to hold the advance of backside boxes during the placement process which is carried out when a previous box, with bottles, is placed in the inner part of the abovementioned frame (B), under the set of placing heads (C1), (C2) and (C3).

In fact, the same FIG. 1 shows that the above mentioned frame (B), includes a superior support frame which carries the above mentioned placing heads (C1), (C2) and (C3), all of them oriented in a vertical plane which is perpendicular to the plane of the above mentioned conveying belt where boxes advance.

Figure 5:
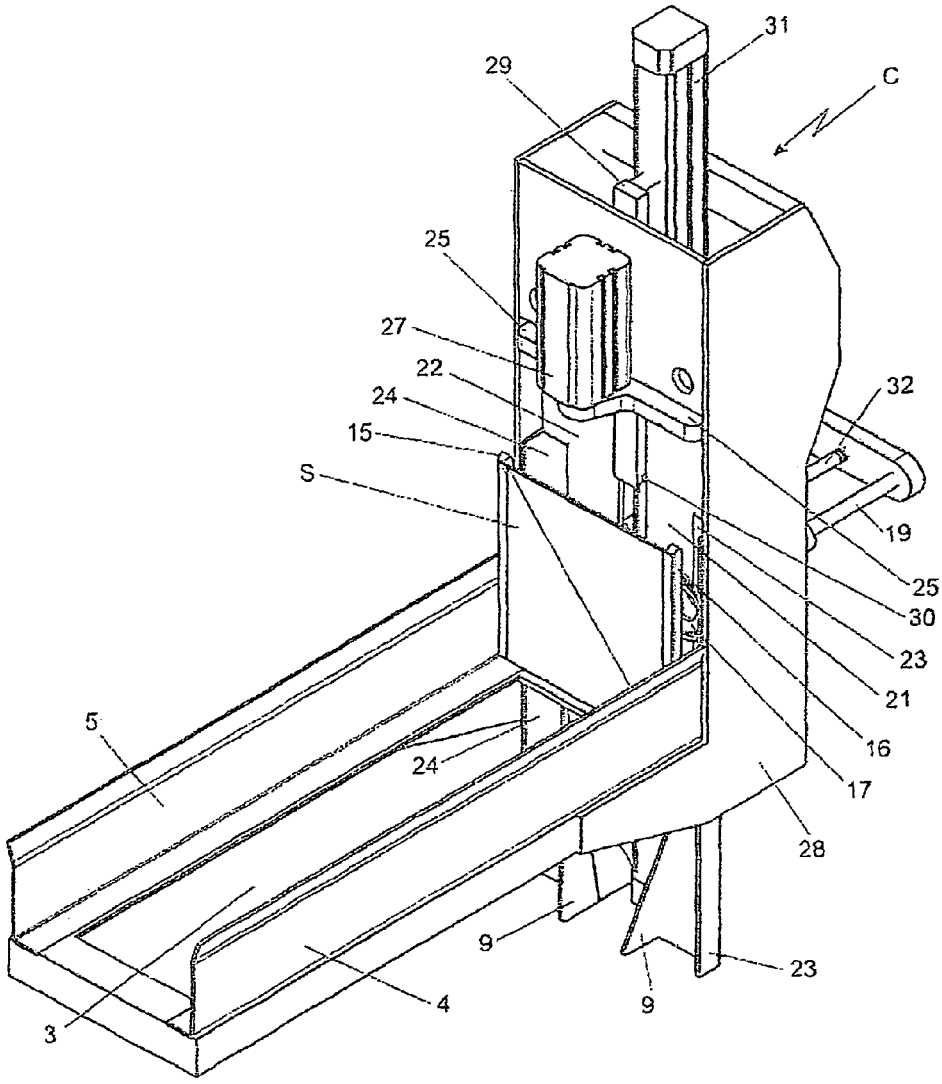
FIG. 5 is a perspective view that shows a placing head in a rest position, with a divider folded before it is taken for placement.

In the same FIG. 1 it is also appreciated that each placing head is linked to a feeding lane (3) of folded dividers (S) which, as shown in FIG. 5 and the subsequent figures is formed by a pair of long angle rods (4) and (5).

It is noted that in the above mentioned figures, a single divider (S) is shown to facilitate the direct observation of parts and elements constituting each applying head (C), however it should be noted that a machine has the capacity to receive about two hundred folded dividers, duly grouped, which will be taken one after the other as explained below.

Figure 2:
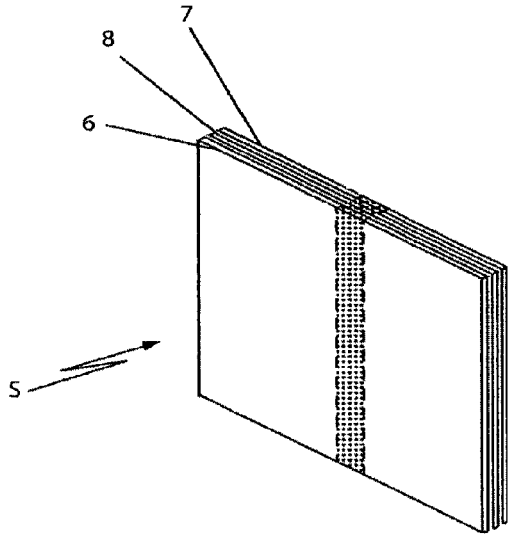
FIG. 2 is a perspective view that shows a divider suitable to be applied on six-bottle packages.

Now observing FIG. 2 it is appreciated, with more detail, how each divider is shown (S) on the machine so that it can be formed and then placed between bottles, in the inner part of a packaging box.

In this preferred example each divider (S) is formed by three solid fiber flexible plates that is: two lateral ones (6) and (7), each one overlaps and is linked to a central plate (8) by means of an adhesive line which extends vertically in a central stretch between opposite faces.

Figure 4:
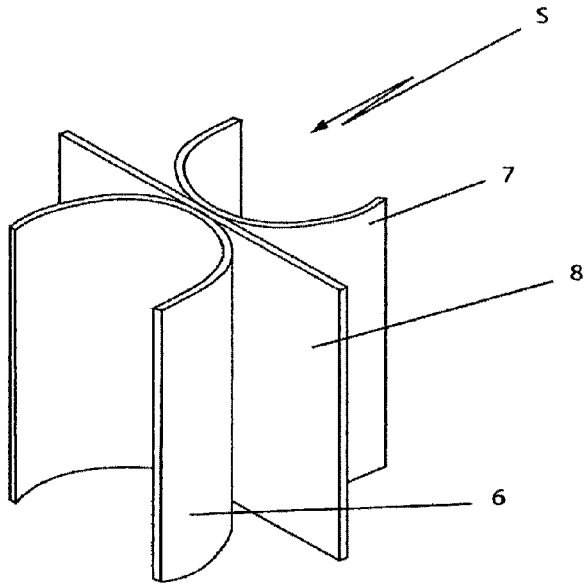
FIG. 4 is a perspective view which represents a divider with its definitive format, of the one which is suitable to be placed in the inner part of a packaging box, by using the machine of this invention.

The same divider (S) when it is unfolded for being placed, takes the format represented in FIG. 4, and is characterized because the above mentioned lateral plates (6) and (7) have been folded outwards to adopt a conformation such as a substantially semi-cylindrical open cavity with a vertical axis which is centrally disposed enclosed between two open lateral cavities which are jointly made with the above mentioned central plate (8).

In each one of said six cavities, in accordance with this preferred example, a bottle is placed in an upright position, all of them contained in a single packaging box.

Figure 3:
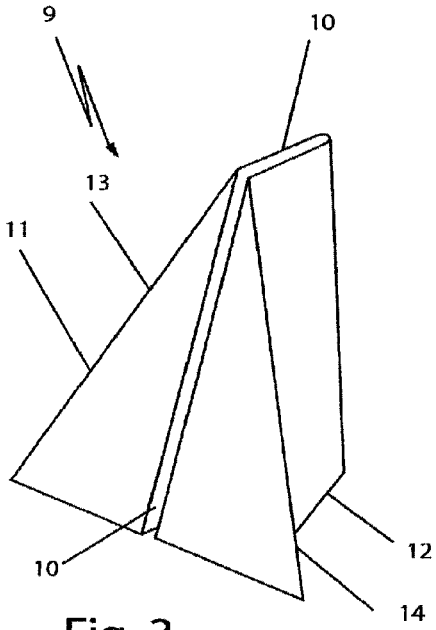
FIG. 3 is a perspective detail that shows the special design which presents the folding guide which integrates the forming set of each placing head.

Now observing FIG. 3, it is possible to explain that, to produce said action of definitive conformation, in each one of the dividers entering the machine, each placing head (C) is a carrier of a forming set which uses special folding guides (9) conceived to produce the above mentioned partial separation and projection outwards of the above mentioned lateral plates (6) and (7).

Therefore, each folding guide (9) is a body of folded sheet which defines a vertical central throat (10) which function is to allow for the entering and passage of the central plate (8) when the folded divider (S) passes through it, in which case the lateral plates (6) and (7) contact the bigger and external sides (13) and (14) of the triangular flaps (11) and (12), being the progressive separation produced outwardly, from marginal stretches, and being them kept linked to the central plate (8), at their respective central lines, until they adopt the definitive format, as described above, which is represented in FIG. 4.

Figure 6:
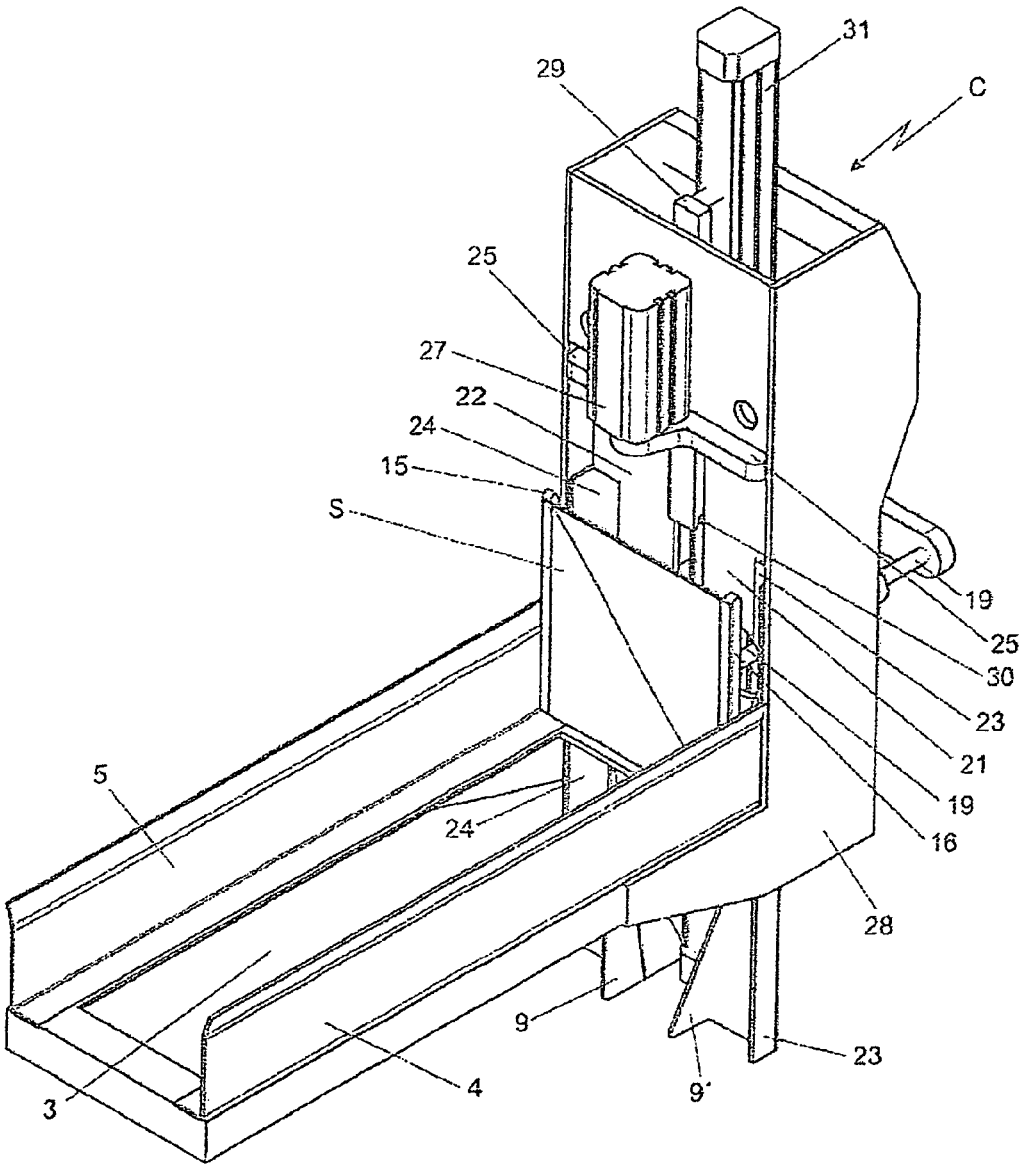
FIG. 6 is also a perspective view, similar to the previous figure, which represents the same placing head, in this case taking a divider in the previous step to place it in conditions suitable to be formed and placed.

Now observing FIGS. 5 and 6 it is possible to appreciate how each placing head (C) of the machine of this invention forms and functions.

It is appreciated that each head (C) comprises a fixed structural frame (28) individually mounted on the higher sector of the frame (B) of the machine.

Once linked and mounted on said frame (28), each placing head (C) comprises a feeding lane (3), providing the dividers (S) by placing them to be taken by an individual extracting means which positions them appropriately, one after the other, and let them act, a combined forming set and a pushing means which, between them provide the definitive format to each divider, and places it by enclosing the bottles placed in the packaging box.

FIGS. 5 and 6, show the presence of a divider (S), which is folded and resting on the long angle rods (4) and (5) which constitute the above mentioned feeding lane of the dividers; being said divider duly positioned on a vertical plane resting on the guide rods (15) and (16).

Figure 7:
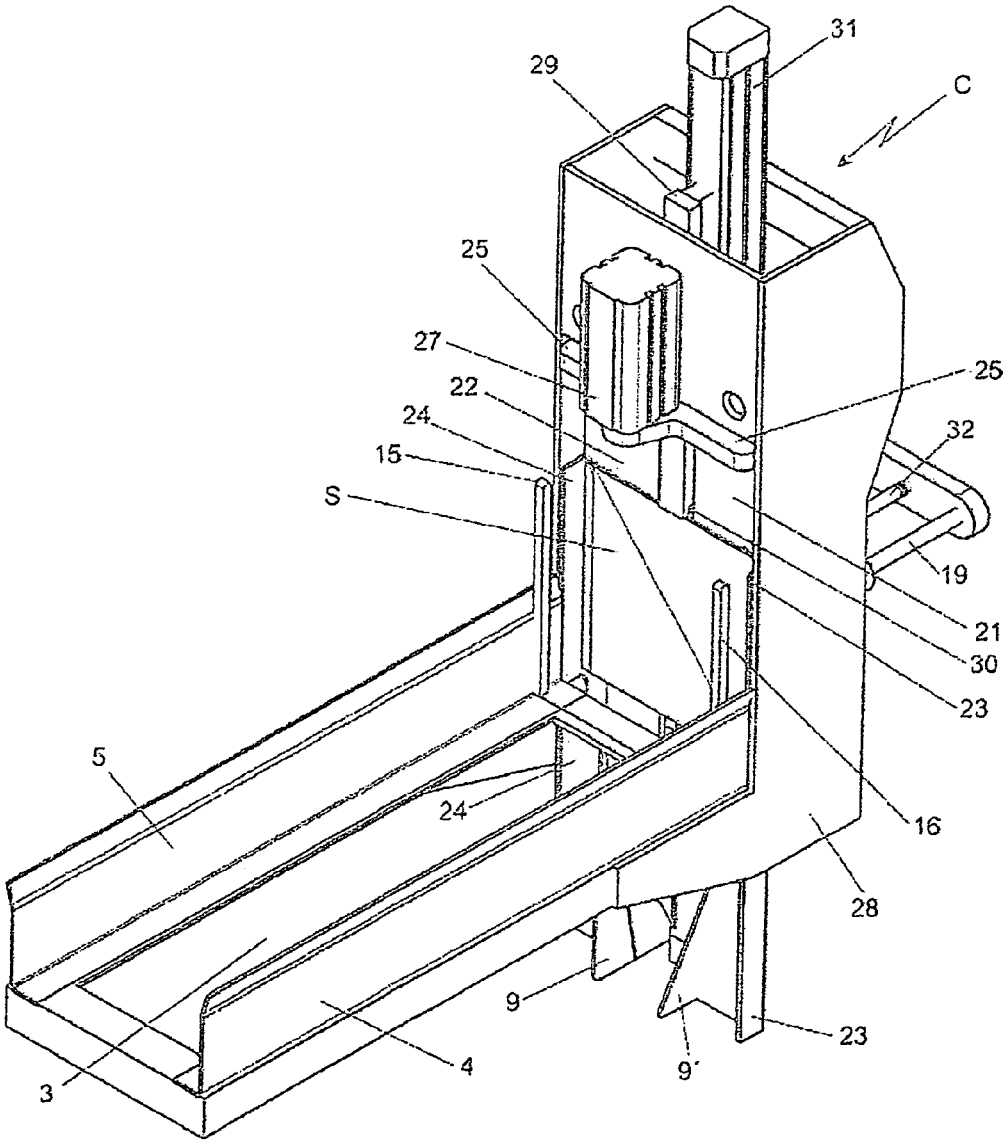
FIG. 7 is also a perspective view, similar to previous figures, which represents the same placing head, in this case with a divider already positioned in the forming set.
Figure 13:
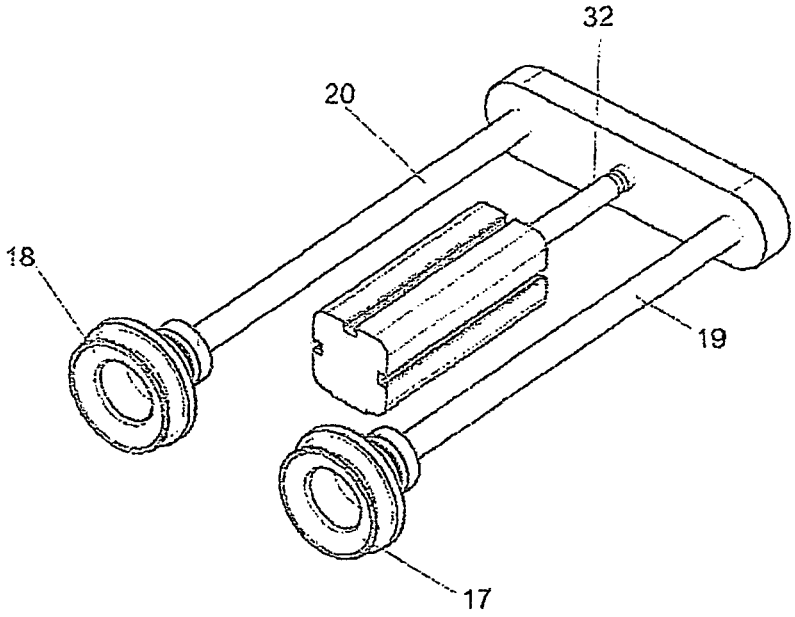
FIG. 13 is a perspective view showing the stem of the pneumatic cylinder and the suction pads.

When the machine is functioning, a pair of pneumatic suctioning pads (17) and (18) act, which are disposed in the free end of the bars (19) and (20) which are projected from the stem of a pneumatic cylinder (32) as shown in FIG. 13, which, after being contacted with the divider (S) execute a suction action to create a small vacuum which is enough to hold it and transfer it to position in a vertical plane aligned with the forming set. (as shown in FIG. 7).

The above mentioned forming set comprises a pair of vertical support plates (21) and (22) along with the intermediate vertical angle profiles (23) and (24) which are, at their free ends, associated with the folding guides (9) and (9').

Likewise, said support plates (21) and (22) are mounted on the higher crossbar (25) which is projected from the free end of the stem (26) (visible in FIGS. 8 and 9) of the pneumatic cylinder (27), through which each dividing head is acted on its vertical displacement upwards or downwards.

As mentioned above, this forming set, acts in combination with the pushing resource (visible in FIG. 7), which is constituted with the pushing bar (29), distinguished because at its lower free end, it shows a transversal slot (30) created to be put on the higher edge of each divider (S).

This bar (29) is commanded from the pushing pneumatic cylinder (31) and is vertically displaced causing the pushing of each divider (S) as regards the respective forming set, therefore disposed on the space defined between the mentioned support plates (21) and (22).

Figure 10:
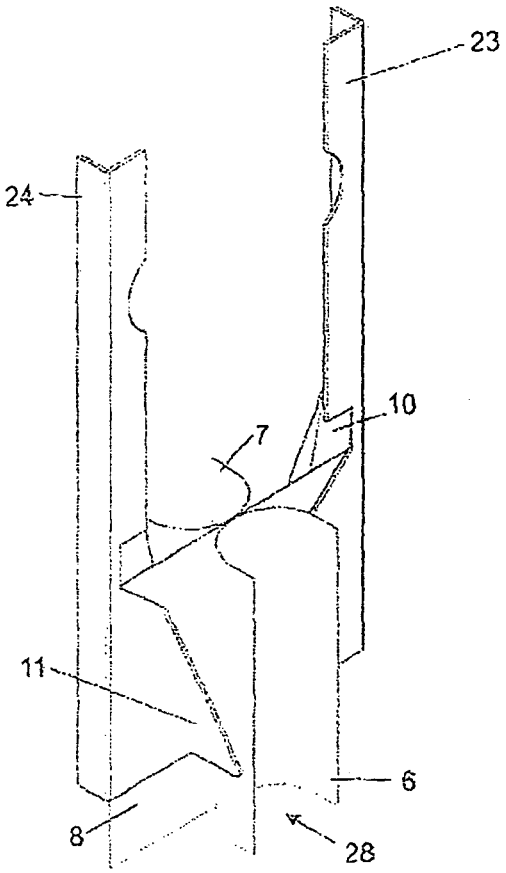
FIG. 10 is an exploded detail which shows, in perspective the lower stretch of a forming set which integrates the machine of this invention, with a divider placed and contained therein.
Figure 11:
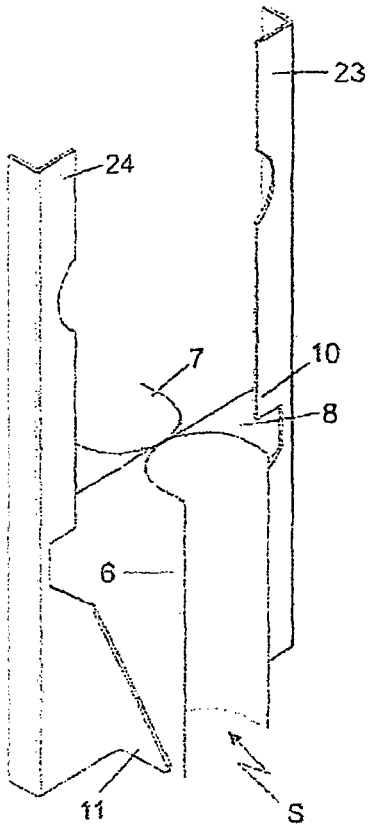
FIG. 11 is a detail, similar to the one of the previous figure, in this case with the divider in a previous operating position to the one shown in the figure above.
Figure 12:
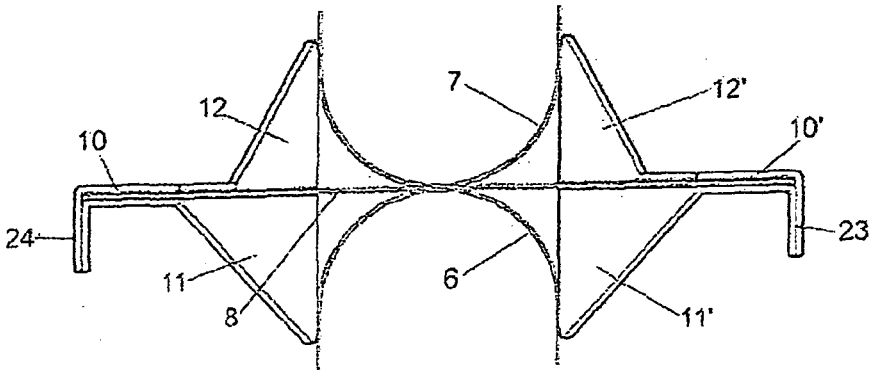
FIG. 12 is a plan view which represents a divider disposed in the forming set in accordance with the present invention.

Being each placing head thus constituted, and observing FIGS. 5 to 9, it may be said that the machine of this invention proceeds in accordance with the following succession of steps:

Now observing FIGS. 10, 11 and 12, it is possible to appreciate how the above mentioned forming sets are configured in their respective lower stretches, where said throats are defined (10) and (10') foreseen to allow for the passage of the central plate (8), as well as the triangular flaps (11) and (12) foreseen to form the lateral plates 6 and 7, which dimensions are as a function of the size and design to be adopted by the divider in each case.

Stage 1: Stand by Placing Head

As shown in FIG. 5, the divider (S) is disposed in a folded position, duly positioned on the feeding lane (3), while the above mentioned suction pads (17) and (18), are folded, facing the divider, appearing through the circular windows respectively made on plates (21) and (22), waiting for the order to advance and take it.

In this stage, the pushing bar (29) is in a rest position, in an elevated position. The above mentioned transversal slot is appreciated (30).

Stage 2: Suction Pads Take the Divider

As shown in FIG. 6, suction pads (17) and (18) got through the corresponding windows and have contacted the divider (S) due to the action of a pneumatic cylinder (not shown) which displaced the bars (19) and (20) outwardly, and, simultaneously, the above action of vacuum in each suction pad was performed, assuring, this way, that the divider (S) is linked to said suction pads.

Stage 3: Positioned Divider

As shown in FIG. 7, once the suction pads hold the divider, they get back (due to the action of the pneumatic cylinder from where the support bars are projected (19) and (20)), until it is duly disposed in alignment with the forming set, and below the above mentioned transversal slot (30) de the pushing bar (29) which also matches the central line of the bottles gathered in the inner part of the packaging box.

Stage 4: Divider (S) being Lowered and Unfolded

Now observing FIG. 8, the combined work of the forming set and the pushing resource is appreciated.

Due to the action of the pushing bar (29) associated to the pneumatic cylinder the divider (S) is displaced downwards in a vertical direction, and getting through the folding guides (9) and (9') which give the definitive format.

It is also noted that the formed set, with the folded guides (9) and (9') is also displaced, in the same direction and sense than the pushing bar (29), in this case due to the action of the pneumatic cylinder (27), accompanying the divider (S) to the entrance to the interior of the packaging box (not shown).

Stage 5: End of Way, Divider (S) Between Bottles

Observing FIG. 8 it is shown that once the divider (S) is at the height of the bottles' neck, the forming set is stopped as now the bottles themselves keep it duly aligned.

In FIG. 9 it is shown that the pushing bar continues to advance by displacing the divider (S) until it is disposed in the definitive position.

As stated above the described machine is suitable to function in a manual mode, in which case the worker will command the above mentioned stages one after the other in accordance with the sequential coordinated and progressive actions, for which a command and control panel may be designed foreseeing this mode of use, where each stage will be activated by turning the respective switch on.

Likewise, through an electronic controller commanded from a PLC the same machine will function in a semi-automatic mode, in which case the worker is only limited to turn the switch on or off any time the box with bottles is in position to receive a respective divider. In this case the worker will activate the process by using a start switch and the machine will perform all the sequential stages even though there, is no box with bottles to receive the divider.

When the machine acts automatically, a set of sensor is incorporated (electronic top, photocells, etc.) linked to the controller, by means of which the normal functioning of all intervening means and resources is verified, being them mechanic or pneumatic, and their action is coordinated, including the top means which prevent the advance of the boxes when being operated, such that, if any of them fails, the machine will automatically turned into the manual mode and an alert indicating that a failure is happening is produced.

Having described and exemplified the nature and main object of the present invention, as well as the way the same will be put into practice, it is claimed as exclusive property and right:

1. A machine for placing protective dividers of bottles contained in packaging boxes, wherein the machine comprises a placing head having a feeding lane of folded dividers which are fed into horizontal sliding pneumatic extracting means having suction pads, which hold the dividers in a unitary form by vacuum, to dispose them in a vertical alignment with a vertically displaceable forming set, actuated by a first pneumatic cylinder including folding guides, which act in combination with a vertical pushing means actuated by a second pneumatic cylinder, through which the folded divider is pushed, thereby unfolding the divider and placing the divider between the bottles, in the packaging box; and, wherein a plurality of suction pads hold the dividers in a unitary form by vacuum and extend from a pair of bars which project from a stem of third pneumatic cylinder which displaces the dividers on a horizontal carrier frame, wherein each of the bars which support the suction pads extend through a circular opening on a vertical plate which forms a portion of the forming set.

2. The machine for placing protective dividers of bottles, according to claim 1, wherein the machine is located in a fixed frame interposed in a packaging line, defining a lower sector where the boxes carrying the bottles pass, and a higher sector having a horizontal carrier frame bearing a placing head.

3. The machine for placing protective dividers of bottles according to claim 1, wherein said forming set comprises a pair of vertical supporting plates having free ends and are associated at their free ends to the folding guides wherein each divider can be displaced vertically, where said supporting plates are mounted on a superior crossbar.

4. The machine for placing protective dividers of bottles, according to claim 1, wherein each folding guide is a body of folded sheet which defines a vertical central throat which allows entering and passing of a central plate of each divider, from where a pair of triangular flaps project which act to unfold each divider.

5. The machine for placing protective dividers of bottles, according to claim 1, wherein the forming set includes a corresponding pushing means formed by a vertical pushing bar which is disposed in a central space defined between the supporting plates which form the forming set, and is associated to a second pneumatic cylinder which functions to displace the divider, which is being unfolded and conformed, until disposition in the packaging box between the contained bottles.

* * * * *